US012291932B2

(12) United States Patent
Mörtzell et al.

(10) Patent No.: US 12,291,932 B2
(45) Date of Patent: May 6, 2025

(54) METHOD AND SYSTEM FOR DETECTING A LOOSENED JOINT OF A DRILL STRING

(71) Applicant: EPIROC ROCK DRILLS AKTIEBOLAG, Örebro (SE)

(72) Inventors: Gustav Mörtzell, Örebro (SE); Thomas Adolfsson, Örebro (SE)

(73) Assignee: EPIROC ROCK DRILLS AKTIEBOLAG, Örebro (SE)

( * ) Notice: Subject to any disclaimer, the term of this patent is extended or adjusted under 35 U.S.C. 154(b) by 0 days.

(21) Appl. No.: 18/551,208

(22) PCT Filed: Mar. 10, 2022

(86) PCT No.: PCT/SE2022/050234
§ 371 (c)(1),
(2) Date: Sep. 19, 2023

(87) PCT Pub. No.: WO2022/203564
PCT Pub. Date: Sep. 29, 2022

(65) Prior Publication Data

US 2024/0159115 A1 May 16, 2024

(30) Foreign Application Priority Data

Mar. 26, 2021 (SE) ..... 2150366-9

(51) Int. Cl.
*E21B 19/16* (2006.01)

(52) U.S. Cl.
CPC ..... *E21B 19/166* (2013.01)

(58) Field of Classification Search
CPC ..... E21B 19/166; E21B 19/165; E21B 19/16
See application file for complete search history.

(56) References Cited

U.S. PATENT DOCUMENTS 2,527,456 A * 10/1950 Schmeling ..... E21B 19/166 73/862.25
3,677,345 A * 7/1972 Sizer ..... E21B 19/16 166/384

(Continued)

FOREIGN PATENT DOCUMENTS

WO 2011138510 A1 11/2011
WO 2019084683 A1 5/2019

(Continued)

OTHER PUBLICATIONS

International Search Report and Written Opinion mailed May 23, 2022 for International Application No. PCT/SE2022/050234, 11 pages.

*Primary Examiner* — Steven A MacDonald
(74) *Attorney, Agent, or Firm* — Sage Patent Group

(57) ABSTRACT

The invention relates to a method for determining the state of a joint joining a first and a second drill string component. A drill rig includes a rotation unit for rotating the drill string and means for determining a representation of a torque applied by the rotation unit. A joint loosening mechanism distinct from the rotation unit apply a joint loosening torque acting on the drill string when loosening a joint. The method includes applying a torque in a joint loosening direction by means of the rotation unit, and applying a joint loosening torque acting on the drill string by means of the joint loosening mechanism.

19 Claims, 5 Drawing Sheets

(56) References Cited

U.S. PATENT DOCUMENTS 4,210,017 A * 7/1980 Motsinger ..... G01L 5/24 702/41
4,402,239 A * 9/1983 Mooney ..... E21B 19/164 81/57.21
4,957,002 A * 9/1990 Coyle, Jr. ..... G01B 7/16 73/761
5,081,888 A * 1/1992 Schulze-Beckinghausen ..... E21B 19/16 81/57.16
RE34,063 E * 9/1992 Vincent ..... E21B 19/166 702/41
6,179,065 B1 * 1/2001 Payne ..... E21B 19/15 175/85
6,491,115 B2 * 12/2002 Van Houwelingen .. E21B 19/08 175/57
7,631,563 B2 * 12/2009 Newman ..... E21B 19/165 73/862.25
7,819,183 B2 * 10/2010 Borgstadt ..... E21B 19/086 166/250.01
7,891,418 B2 * 2/2011 Begnaud ..... E21B 19/165 166/85.1
8,074,537 B2 * 12/2011 Hunter ..... F16L 15/006 81/57.2
8,899,319 B2 * 12/2014 Patterson ..... E21B 19/165 166/380
10,167,688 B2 * 1/2019 Jelgert ..... E21B 19/165
2007/0295108 A1 * 12/2007 Manella ..... E21B 19/16 73/862.25
2008/0125876 A1 5/2008 Boutwell
2009/0095526 A1 * 4/2009 Lane ..... E21B 19/083 700/275
2010/0101805 A1 * 4/2010 Angelle ..... E21B 19/16 166/380
2010/0132180 A1 6/2010 Conquergood et al.
2014/0116687 A1 * 5/2014 Ruehmann ..... E21B 19/166 166/250.01
2014/0121048 A1 5/2014 Bowley et al.
2014/0224481 A1 * 8/2014 Scheibelmasser ..... E21B 47/12 166/250.01
2015/0107850 A1 * 4/2015 Mosing ..... E21B 19/164 81/57.16
2015/0218895 A1 * 8/2015 Hassan ..... E21B 15/00 175/24
2018/0281132 A1 * 10/2018 Melnikov ..... F16B 25/0057
2018/0363443 A1 * 12/2018 Guertin ..... E21B 19/15
2019/0119997 A1 * 4/2019 Helms ..... G01L 5/24
2019/0136669 A1 * 5/2019 Wiedecke ..... E21B 44/00
2019/0309878 A1 * 10/2019 Ruehmann ..... E21B 10/62
2020/0263505 A1 * 8/2020 Schrinner ..... E21B 17/042
2021/0355766 A1 * 11/2021 Skaarsjoe ..... G01L 5/24
2023/0203898 A1 * 6/2023 Mccorriston ..... E21B 19/166 166/250.01
2024/0159115 A1 * 5/2024 Mortzell et al. ..... E21B 19/166

FOREIGN PATENT DOCUMENTS

WO 2020172144 A1 8/2020
WO WO-2022140593 A1 * 6/2022 ..... E21B 19/15

* cited by examiner

METHOD AND SYSTEM FOR DETECTING A LOOSENED JOINT OF A DRILL STRING

CROSS-REFERENCE TO RELATED APPLICATIONS

This application is a 35 U.S.C. § 371 national stage application for International Application No. PCT/SE2022/050234, entitled "METHOD AND SYSTEM FOR DETECTING A LOOSENED JOINT OF A DRILL STRING", filed on Mar. 10, 2022, which itself claims priority to Swedish Patent Application No. 2150366-9, filed on Mar. 26, 2021, the disclosures and contents of which are hereby incorporated by reference in their entireties.

FIELD OF THE INVENTION

The present invention relates to mining, and, more specifically, to a method and system for detecting whether a joint of a drill string has been loosened. The invention also relates to a computer program implementing the method according to the invention, as well as a system and a drill rig.

BACKGROUND OF THE INVENTION

Rock drilling rigs may be used in a number of areas of application. For example, rock drilling rigs may be utilised in tunnelling, surface mining, underground mining, rock reinforcement, raise boring, and be used e.g. for drilling blast holes, grout holes, holes for installing rock bolts, water wells and other wells, piling and foundations drilling etc. There is hence a vast use for rock drilling rigs.

The actual breaking of the rock is oftentimes carried out by a drill bit contacting the rock, where the drill bit is connected to a drilling machine, in general by means of a drill string. The drilling can be accomplished in various ways, and e.g. be of a percussive type, where a percussion element of a drilling machine repeatedly strikes a drill bit, where the drilling machine may be connected directly to the drill bit such as in DTH/ITH drilling, or alternatively via a drill string connecting the drilling machine to the drill bit, to transfer percussive pulses in the form of shock/stress waves to the drill bit and further into the rock. Percussive drilling may be combined with rotation in order to obtain a drilling where buttons, inserts, of the drill bit strikes fresh rock at each stroke, thereby increasing the efficiency of the drilling. Rotation drilling may also be utilised.

A plurality of drill rods may be joined together by means of joints when drilling longer holes in order to lengthen the drill string to allow that a hole of a desired length may be drilled. The drill rods are in general threaded, and further drill rods are therefore added by being threaded together with the current drill string as the drilling of the hole progress. Following a concluded drilling operation, i.e. drilling of a particular hole, the drill string is retrieved from the drilled hole, rod by rod, where the drill string is pulled backwards and the drill rods are decoupled from each other.

The joints of the drill rods may become such firmly tightened during drilling that a high loosening torque may be required to loosen the joints and thereby allow the drill rods to be separated from each other and removed from the drill string. There exist various solutions for accomplishing the loosening of the joints, where e.g. a joint loosening mechanism may be utilised. The joint loosening mechanism applies a joint loosening torque by means of a lever action acting on the drill string. Solutions of this kind, however, may impose excessive wear on the drill string components.

SUMMARY OF THE INVENTION

It is an object of the invention to provide a method and system that may be utilised in the loosening of joints to avoid subjecting components to excessive wear during the joint loosening process. According to embodiments of the invention it is also provided a method and system that may increase the available loosening torque that is available in the loosening of a joint.

According to the invention, it is provided a method for determining whether a joint of a drill string of a drill rig is loosened by an attempt to loosen the joint, the joint joining a first and a second drill string component. The drill rig comprises a rotation unit for rotating the drill string during drilling and means for determining a representation of a torque applied to the drill string by the rotation unit. A joint loosening mechanism, distinct from the rotation unit, is configured to, when loosening a joint, applying a joint loosening torque acting on the drill string.

The method comprises, when loosening a joint of the drill string:

- applying a torque in a joint loosening direction by means of the rotation unit;
- applying a joint loosening torque acting on the drill string by means of the joint loosening mechanism;
- monitoring the representation of the torque applied by the rotation unit during the applying of the joint loosening torque by means of the joint loosening mechanism;
- determining whether the joint is loosened based on the monitored representation of the torque applied by the rotation unit; and
- generating a signal representing a loosened joint when the determining indicates that the joint has been loosened.

The rotation unit may form part of a drilling machine of the drill rig or constitute a unit being separate from the drilling machine. According to embodiments of the invention, the drilling machine comprises a percussive element for inducing shock waves into the drill string during drilling. According to embodiments of the invention the drilling machine carries out the drilling through rotation only.

Properly tightened joints are a requirement for efficient drilling. The tightening of the normally threaded joints in general also becomes firm during drilling, e.g. as a consequence of shock waves passing through the joints during drilling.

At some point, however, the tightened joints will be loosened and the drill string components, i.e. rotation unit, drilling machine, drill rods and/or drill bit, be separated from each other. For example, following drilling of a hole the drill string is retracted and the drill rods loosened from each other. However, this also applies when the length of a drill rod has been drilled and a further drill rod is to be added to the drill string. In some situations, the joint loosening torque that is available through the rotation unit is sufficient to loosen the joint. In such situations, it is sufficient to clamp the drill string downstream the joint by suitable gripping means to allow the rotation unit to apply a joint loosening torque. During drilling, however, the joints may become so firmly tightened that the joints cannot be loosened only with the assistance of a rotation unit.

In such situations, a joint loosening mechanism being distinct from the rotation unit may be utilised. This joint loosening mechanism may e.g. be, but is not limited to, a so called breakout tool, which may also be denoted break table, breakup or breakout table, breakup tool. Other denominations of solutions of this kind may also occur. For reasons of simplicity the term breakout tool is used in the following. The breakout tool, or any other solution being encompassed by the invention and being capable of firmly clamping the components being joint by the joint by means of gripping means such as jaws, while simultaneously applying a rotational motion to one of the drill string components being joint by the joint through lever action, e.g. by a hydraulic cylinder acting on the gripping jaws clamping one of the joint components. A problem of such solutions is that it is not possible to detect whether the joint was actually loosened by an attempt to loosen the joint, or whether the gripping means of the joint loosening mechanism has been sliding on the drill string component without properly clamping the drill string component so that no or only little loosening torque was actually acting on the joint. This, in turn, has resulted in a solution where the joint loosening torque is consecutively applied a plurality of times to ensure that the joint is loosened prior to unthreading and separating the joined components.

Solutions of this kind, however, results in excess wear on both drill string components as well as the joint loosening mechanism. In addition, the repeated loosening attempts consumes time.

According to embodiments of the invention such problems may be mitigated by a method where it is detected whether the joint was actually loosened by the applying of a torque using the joint loosening mechanism.

This is accomplished by applying a torque in a joint loosening direction by means of the rotation unit, such as a rotation motor, of the drilling rig prior to applying a joint loosening torque using the joint loosening mechanism. The drill string may be locked against rotation at least downstream the joint as seen from the rotation unit prior to applying a torque by the rotation unit. This applied torque in general therefore do not result in an actual rotation of the drill string at this stage.

A representation of the torque applied by the rotation unit is then monitored during the applying of the joint loosening torque by means of the joint loosening mechanism, and it is determined whether the joint has been loosened by this action based on the monitored representation of the torque applied by the rotation unit. A signal representing a loosened joint is generated when the determining indicates that the joint has been loosened. In this way, the rotation unit is utilised to determine whether the joint was actually loosened by the joint loosening mechanism. If the joint was loosened during the first loosening attempt this can be detected so that further attempts need not be carried out and excessive wear be avoided and time saved. Instead, the joint can be unthreaded to separate the drill string components from each other. In case the rotation unit is a hydraulic rotation unit, the representation of the torque applied by the rotation unit may be a hydraulic pressure applied to the rotation unit.

According to embodiments of the invention, the representation of the torque applied by the rotation unit is monitored while applying a loosening torque by the joint loosening mechanism, and it is determined that the joint is loosened when a predetermined variation in the monitored representation of the torque applied by the rotation unit is detected. The torque applied by the joint loosening mechanism will give rise to a rotation of the drill string if the joint is loosened, and this rotation will influence the torque provided by the rotation unit, and when a predetermined variation is detected it can be concluded that the loosening of the joint was successful. In case the rotation unit is a hydraulic rotation unit, a variation in the pressure acting on the rotation unit may be monitored.

According to the embodiments of the invention, it is determined that the joint is loosened when the monitored representation of the torque applied by the rotation unit falls below a predetermined threshold. That is, the joint is determined to be loose only if a sufficiently large reduction of a value representing the torque, such as a pressure, applied by the rotation unit is detected. In case only a small rotation of the drill string is accomplished by the joint loosening mechanism, and the joint thereby does not sufficiently loosen, this may not give rise to a sufficiently large reduction and hence not be detected as a loosening of a joint.

According to embodiments of the invention the settings of the rotation unit is set to a first speed of rotation, wherein the first speed of rotation is lower than a speed of rotation being imposed by the joint loosening mechanism when applying a torque to the drill string. In this way, when the drill string is caused to rotate by the joint loosening mechanism, the speed of rotation will exceed the set speed of rotation of the rotation unit, so that the torque provided to the rotation unit will not be sufficient for the current speed of rotation of the drill string and therefore reduce.

According to embodiments of the invention, the joint loosening torque applied by means of the rotation unit act together with the joint loosening mechanism such that the total loosening torque applied to the drill string, at least prior to the drill string starts rotating, exceeds the torque applied by the joint loosening mechanism. This provides for a solution resulting in a higher total loosening torque, which increases the possibilities of loosening the joint.

According to embodiments of the invention, the applying of torque by the rotation unit and the applying of a joint loosening torque by means of the joint loosening mechanism is repeated when the representation of the torque applied by the rotation unit indicates that the joint is still tightened following the applying of a joint loosening torque by the joint loosening mechanism. The additional one or more attempts may increase the probability of loosening the joint, while simultaneously only being utilised when, and to the extent that, it is concluded that the joint has not been loosened. Repeated attempts are hence only utilised in situations where this is motivated.

According to embodiments of the invention, an alert signal indicating a malfunction is generated when the applying of a torque by the rotation unit and the applying of a joint loosening torque by means of the joint loosening mechanism have been repeated for a predetermined number of times without establishing that the joint has been loosened. In this way the drill rig control system or an operator can be made aware of the fact that the loosening of the joint has not succeeded and proper actions be taken.

According to embodiments of the invention, the joint loosening mechanism comprises first clamping means for releasably holding the drill string against rotation upstream the joint in relation to the rotation unit, i.e. on the rotation unit side of the joint, and second clamping means for releasably holding the drill string downstream the joint in relation to the rotation unit.

According to embodiments of the invention, the joint loosening mechanism comprises lever means for applying a torque to the drill string through the grip of the first clamping means. This provides for a solution that is capable of providing a high loosening torque.

According to embodiments of the invention, the grip of the first clamping means is released when the monitoring of the representation of the torque applied by the rotation unit indicates a loosening of the joint. This allows that the joint may be unthreaded by means of the rotation unit to release the drill string components from each other following loosening of the joint.

According to embodiments of the invention, the rotation unit is hydraulically powered and e.g. comprising a rotation motor. In this case the representation of the torque applied by the rotation unit may be monitored by monitoring a hydraulic pressure of the rotation unit. The pressure may be monitored by means of one or more pressure sensors. The rotation unit may further be controlled to be set to a predetermined speed of rotation, and a rotation pressure acting on the rotation unit in an unthreading direction can be applied prior to applying the torque by the joint loosening mechanism. The rotation pressure may be continuously increased until at least a predetermined rotation pressure is reached, after which torque can be applied by the torque loosening mechanism.

According to embodiments of the invention it is determined whether the joint is loosened based on a variation in the monitored rotation pressure, in particular whether there is at least a predetermined pressure drop while applying the loosening torque by the joint loosening mechanism.

According to embodiments of the invention, the applying of the joint loosening torque by means of the joint loosening mechanism is immediately stopped when it is determined during ongoing applying of torque that the joint has been loosened. Consequently, the joint loosening mechanism may be only used to precisely the extent required to loosen a joint. This further reduces e.g. wear of drill string components and joint loosening mechanism.

The method according to the invention may partly or fully be carried out by means of a drill rig control system of the drill rig.

Further characteristics of the present invention and advantages thereof are indicated in the detailed description of exemplary embodiments set out below and the attached drawings.

DETAILED DESCRIPTION OF EXEMPLARY EMBODIMENTS

Embodiments of the present invention will be exemplified in the following in view of a particular kind of drill rig, where drilling is carried out through the use of a percussion device in the form of a down-the-hole (DTH)/in-the-hole (ITH) hammer. The invention is, however, applicable also for other kinds of drill rigs where a rotation unit, e.g. consisting of or comprising a rotation motor, is utilised to rotate the drill string during drilling. The drill rig may also be of any other kind, with or without a percussion device, where a rotation unit that rotates the drill string during drilling is utilised, and where a loosening torque is applied to the drill string through the use of a lever action. For example, the drilling machine as well as rotation unit may be arranged on the opposite end of the drill string in relation to the drill bit, such as on a carriage of a feed beam, and the drilling machine and rotation unit may also form an integrated unit providing both percussion and rotation or drilling by rotation only. The invention is also applicable for drill rigs comprising other kinds of drilling machines than hydraulically driven drilling machines, such as drilling machines operated by electrical or pneumatical means.

Figure 1:
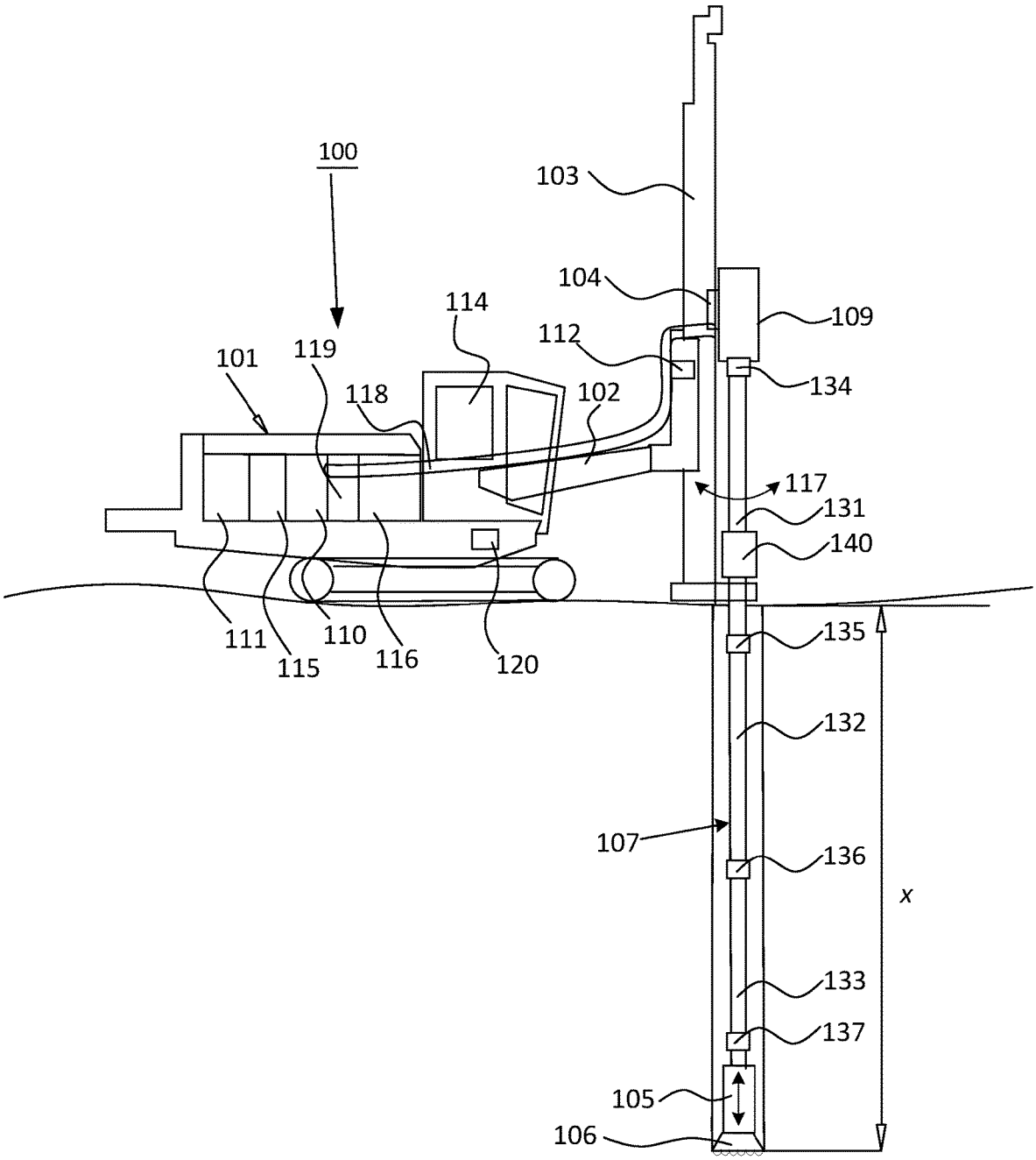
FIG. 1 illustrates an exemplary drill rig in which embodiments of the invention may be utilised.

FIG. 1 illustrates a rock drilling rig 100 according to an exemplary embodiment of the present invention for which an inventive method of determining a status of at least one joint of the drill string will be described. The drill rig 100 is in the process of drilling a hole, where the drilling currently has reached a depth x.

The rock drilling rig 100 according to the present example constitutes a surface drill rig, although it is to be understood that the drill rig may also be of a type being primarily intended e.g. for underground drilling, or a drill rig for any other use. The rock drilling rig 100 comprises a carrier 101, which carries a boom 102 in a conventional manner. Furthermore, a feed beam 103 is attached to the boom 102. The feed beam 103 carries a carriage 104, which is slidably arranged along the feed beam 103 to allow the carriage 104 to run along the feed beam 103. The carriage 104, in turn, carries a rotation unit 109, where the rotation is indicated by 117. The rotation unit 109 is connected to a percussion device, i.e. drilling machine, in the form of a down-the-hole (DTH) hammer 105 by means of a drill string 107. The rotation unit 109 may provide rotation in both directions of rotation. The rotation unit 109 may hence run along the feed beam 103 by sliding the carriage 104. The rotation unit 109, in addition to rotating the drill string 107, also provides a feed force acting on the drill string 107 to thereby press the drill bit 108 against the rock face being drilled.

As the name implies, the DTH hammer (percussion device) 105 works down the hole at the end of the drill string 107, where an impact piston (not shown) of the DTH hammer 105 strikes a drill tool such as a drill bit 106 in order to transfer shock wave energy to the drill bit 106 and further into the rock for breaking thereof. DTH hammers are useful, inter alia, in that the drilling rate is not considerably affected by the length/depth of the hole being drilled. The rotation provided by the rotation unit 109 hence transmits the rotation to the hammer 105, and thereby drill bit 106, via the drill string 107.

The drill string 107 may consist of a single drill rod being threaded together with the rotation unit 109 and the percussion device 105 (to which the drill bit is also threaded). The drill string 107, however, oftentimes does not consist of a drill string in one piece, but, instead, of a number of drill rods. When drilling has progressed a distance corresponding to a drill rod length, a new drill rod is threaded together with the one or more drill rods that already has been threaded together to form the drill string, whereby drilling can progress for another drill rod length before a new drill rod is threaded together with existing drill rods. Drill rods of the disclosed kind may be extended essentially to any desired length as drilling progress. This is illustrated by drill rods 131-133, which are joined together by threaded joints 135, 136. It is to be noted that the invention is applicable to drill strings having any number of joints. The drill bit 106 is threaded together with drill rod 133 by means of a threaded joint 137.

Furthermore, the percussion device 105 comprises a percussive element in the form of a percussion piston acting on the drill bit 106.

In use, the percussion piston of the percussion device 105 repeatedly strikes the drill bit 106 in order to transfer shock wave energy into the rock for breaking thereof. The rotation unit 109 provides rotation of the drill string 107 during drilling to ensure that drill bit inserts of the drill bit 106 are indexed between strokes of the percussion piston to avoid the drill bit inserts from repeatedly striking the rock in the same manner.

According to the illustrated example, the rotation unit 109 is powered by pressurised hydraulic fluid being supplied to the percussion device by one or more hydraulic pumps 116 arranged on the carrier 101 and suitable hosing 118. The carrier 101 also comprises a hydraulic fluid tank 119 from which hydraulic fluid is taken and returned to using the hydraulic circuit powering the rotation unit 109. There may be further hydraulic pumps being used to provide pressurised hydraulic fluid in one or more additional hydraulic circuits, such as e.g. a damping circuit.

Furthermore, the DTH hammer 105 is driven by compressed air and for this reason compressed air is led to the hammer 105 through a channel inside the drill string 107, where the compressed air is supplied to the drill string 107 from a tank 115 through a suitable coupling, and a hose or other suitable means as is known per se and therefore not illustrated herein. The compressed air is generated by a compressor 110, which may charge the tank 115 from which the compressed air is supplied to the drill string. Exhaust air from the DTH hammer 105 may be discharged through holes in the drill bit to be used to clean the drill hole from drilling remnants as is also in general the case.

The hydraulic pumps 116, compressor 110 and other power consumers such as e.g. further compressors and further hydraulic pumps are driven by a power source 111, e.g. in the form of a combustion engine such as a diesel engine or any other suitable power source, such as e.g. an electric motor, or combination of power sources. FIG. 1 also illustrates a pressure sensor 112 being used to measure the pressure of the hydraulic circuit powering the rotation unit 109. It is to be understood that various other pressure sensors, and also other types are sensors are utilised in connection with drill rigs of the disclosed example. Such sensors are not illustrated for reasons of simplicity.

The rock drilling rig 100 further comprises a rig control system comprising at least one control unit 120. The control unit 120 is configured to control various of the functions of the drill rig 100, such as controlling the drilling process. In case the drill rig 100 is manually operated, the control unit 120 may receive control signals from the operator, e.g. being present in an operator cabin 114 through operator controllable means such as joysticks and other means requesting various actions to be taken, and where the control signals, such as operator inflicted joystick deflections and/or maneuvering of other means, may be translated by the control system to suitable control commands. The control unit 120 may, for example, be configured to request motions to be carried out by various actuators such as cylinders/motors/pumps etc., e.g. for maneuvering boom 102, feeder 103 and controlling the percussion device 105 and rotation unit 109, and various other functions. The described control, as well as other functions, may alternatively be partly or fully autonomously controlled by the control unit 120.

Drill rigs of the disclosed kind may also comprise more than one control unit, e.g. a plurality of control units, where each control unit, respectively, may be arranged to be responsible for monitoring and carrying out various functions of the drill rig 100. For reasons of simplicity, however, it will be assumed in the following that the various functions are controlled by the control unit 120. Such control systems may further utilise any suitable kind of data bus to allow communication between various units of the drill rig 100. In case the drill rig 100 is maneuvered by an operator various data may be displayed e.g. on one or more displays in the operator cabin 114.

According to embodiments of the invention, loosening of the joints according to embodiments of the invention is partly or fully performed by a control unit of the drill rig, such as control unit 120 of FIG. 1.

With regard to loosening of the joints, the drill rig 100 of FIG. 1 further comprises a joint loosening mechanism, schematically indicated by 140 in FIG. 1, and which will be described more in detail below with reference to FIG. 3.

As was discussed above, when the drilling of a hole is finished, the drill rod is retracted from the drilled hole where, during the retraction, the components forming the drill string are loosened from each other as the drill string is being pulled out. Similarly, when the length of a rod has been drilled, the rotation unit is loosened from the drill rod that has just been drilled so that a further drill rod may be added to the drill string.

During drilling, however, the joints may become tightened to a degree where rotation/torque that may be applied by the rotation motor will not be sufficient to loosen the joints. Therefore, as discussed above, a method is commonly used where a joint loosening, or breakup, mechanism, such as a breakout tool, is used to break, i.e. loosen, the joints so that the e.g. drill rods being threaded together during drilling can be separated from each other also in situations where a rotation motor is not capable of providing a joint loosening torque (i.e. torque applied in a loosening direction of the joint) that is sufficient to break, i.e. loosen the joint. The joint breakup mechanism 140 is called breakout tool in the present description, but may, as discussed, also have various other denominations and be of various designs.

As was also discussed above, it may not be possible to determine whether a joint loosening action of the breakout tool has actually loosened the joint.

Figure 2:
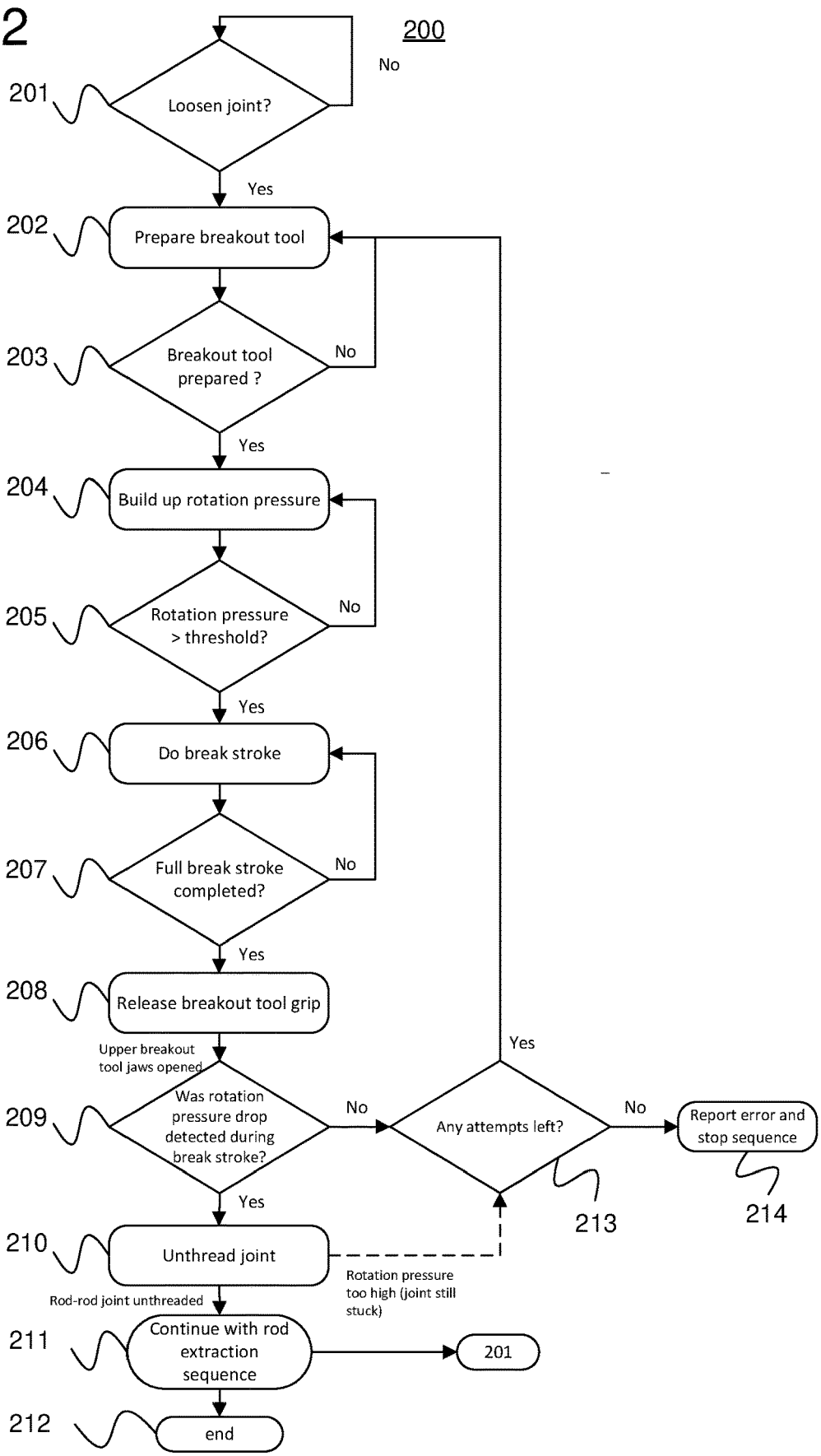
FIG. 2 illustrates an exemplary method according to embodiments of the invention.

FIG. 2 illustrates an exemplary method according to embodiments of the invention by means of which it is possible to detect whether a joint loosening action has actually loosened the joint. The method starts in step 201 where it is determined whether a joint is to be loosened. This determination may be carried out automatically by the drill rig control system in case drilling is fully automatically controlled. The initiation of the method according to FIG. 2 may also be carried out e.g. by an operator requesting the loosening of the joint to be initiated. According to embodiments of the invention, the method may include a step of positioning the drill string, in particular the joint to be loosened, in a suitable position for properly accomplishing the loosening of the joint. Such positioning of the drill string may be carried out by an operator, or automatically by the drilling control system. In particular, this positioning relates to the positioning of the joints in relation to the breakout tool.

The transition from step 201 to step 202 may e.g. be dependent on an indication that the drill string, in fact, is in position for performing a loosening of the joint according to embodiments of the invention, where such indication may be provided by the drill rig control system or e.g. be implicit by an operator requesting the method to be carried out. The method remains in step 201 for as long as no joint is to be loosened, whereas the method continues to step 202 when a joint is to be loosened according to embodiments of the invention.

When it is determined in step 201 that a joint is to be loosened, and, according to embodiments of the invention, that the drill string is in the position for loosening the joint, the joint loosening mechanism, the breakout tool according to the present example, is prepared for loosening the joint in step 202. An exemplary breakout tool 300 is illustrated in FIG. 3. As was mentioned above, the breakout tool is also schematically illustrated in FIG. 1, denoted by 140. The breakout tool 300 of FIG. 3 is intended for illustrative purposes only, and it is to be realized that the joint loosening mechanism may be of various different designs and configurations. However, common for such designs and configurations of the joint loosening mechanism is that it is provided with means for clamping the drill string and providing a torque by means of a lever action.

Figure 3:
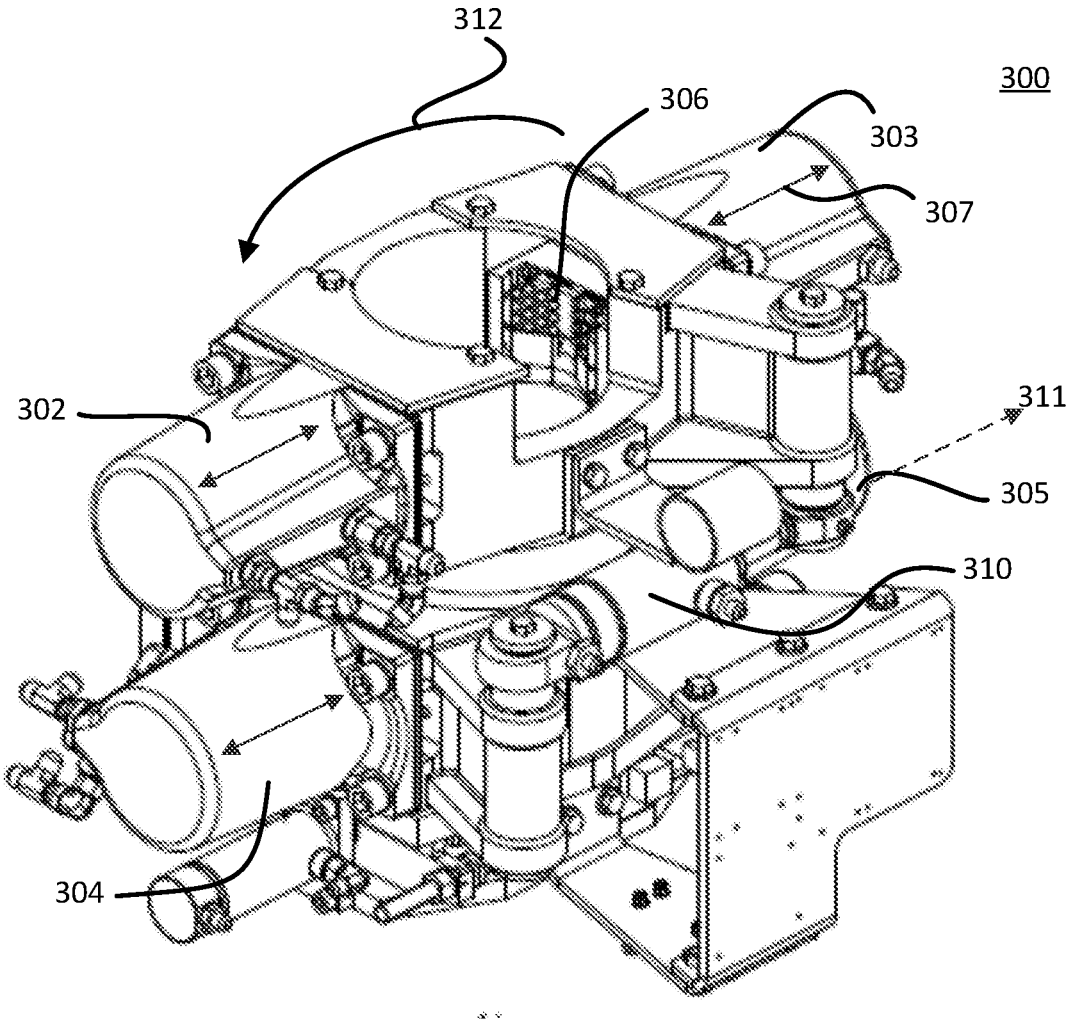
FIG. 3 illustrates an exemplary joint loosening mechanism according to embodiments of the invention.

According to the exemplary embodiment of FIG. 3, the breakout tool 300 comprises clamping means 302, 303, 304, 305 for clamping the drill string. The clamping means 304, 305 are utilized to clamp the drill string on one side of the joint to be loosened, and hence one of the drill string components being joint by the joint, whereas clamping means 302, 303 are used clamp the drill string on the other side of the joint, and hence the other of the drill string components being joint, to be loosened. Each of the clamping means 302-305 comprises gripping means e.g. in the form of jaws 306. It is to be noted that the gripping means and hence jaws are only visible in the figure for clamping element 303. The gripping means 306 connects to the drill string components by friction when being pressed against the drill rod, where such force may be applied e.g. by means of a hydraulic cylinder situated in the housing of the clamping means 303, respectively. The hydraulic cylinder of a clamping means selectively presses the jaws against the drill string or releases the grip of the drill string as illustrated by arrows 307.

Figure 5:
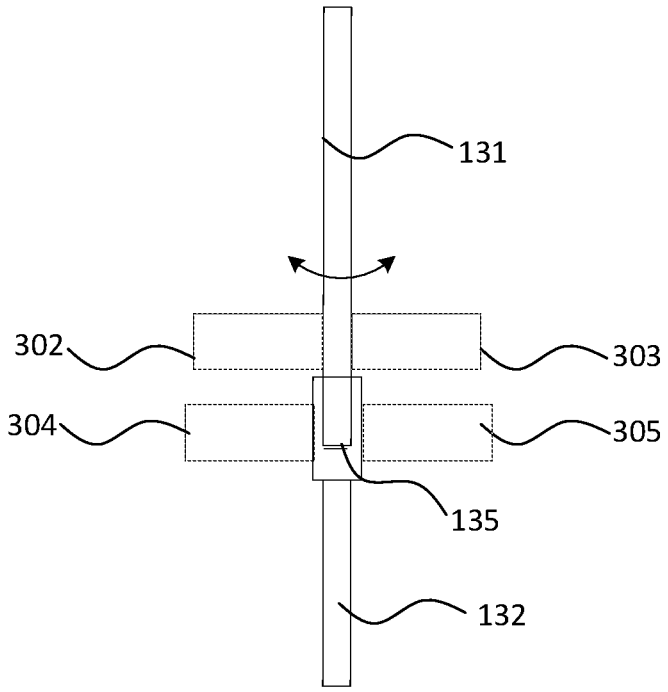
FIG. 5 illustrates clamping of a drill string by a joint loosening mechanism according to embodiments of the invention.

The clamping means works in pairs, respectively, for clamping the drill string on the respective side of the joint. That is, clamping means 302, 303 clamps the drill string on one side of the joint, and hence one of the drill string components that are to be loosened from another, by being operated in unison to provide a frictional grip of the drill rod to prevent the drill string from being rotated in relation to the jaws of the clamping means. Similarly, clamping means 304, 305 clamps the drill string on the other side of the joint and hence the other of the drill string components that are to be loosened from each other. This is schematically illustrated in FIG. 5, for joint 135 of FIG. 1, where clamping means 302, 303 clamp drill string component 131, and clamping means 304, 305 clamp drill string component 132.

Consequently, in step 202 when preparing the breakout tool, the upper and lower breakout tool clamping means 302-305, are operated to firmly grip the drill string on both sides of the joint, and hence both of the drill string components that are to be loosened from each other. This control is performed by the drill rig control system.

In addition to clamping the drill string by means of the clamping means 302-305, it is also ensured that a break stroke cylinder 310 is in a correct position for performing a break stroke as will be discussed below. In general, the break stroke cylinder 310 is set to the correct position prior to clamping the drill string by means of the clamping means 302, 303 which, as will be explained below, participate in the joint loosening stroke (also known e.g. as break stroke).

Figure 4:
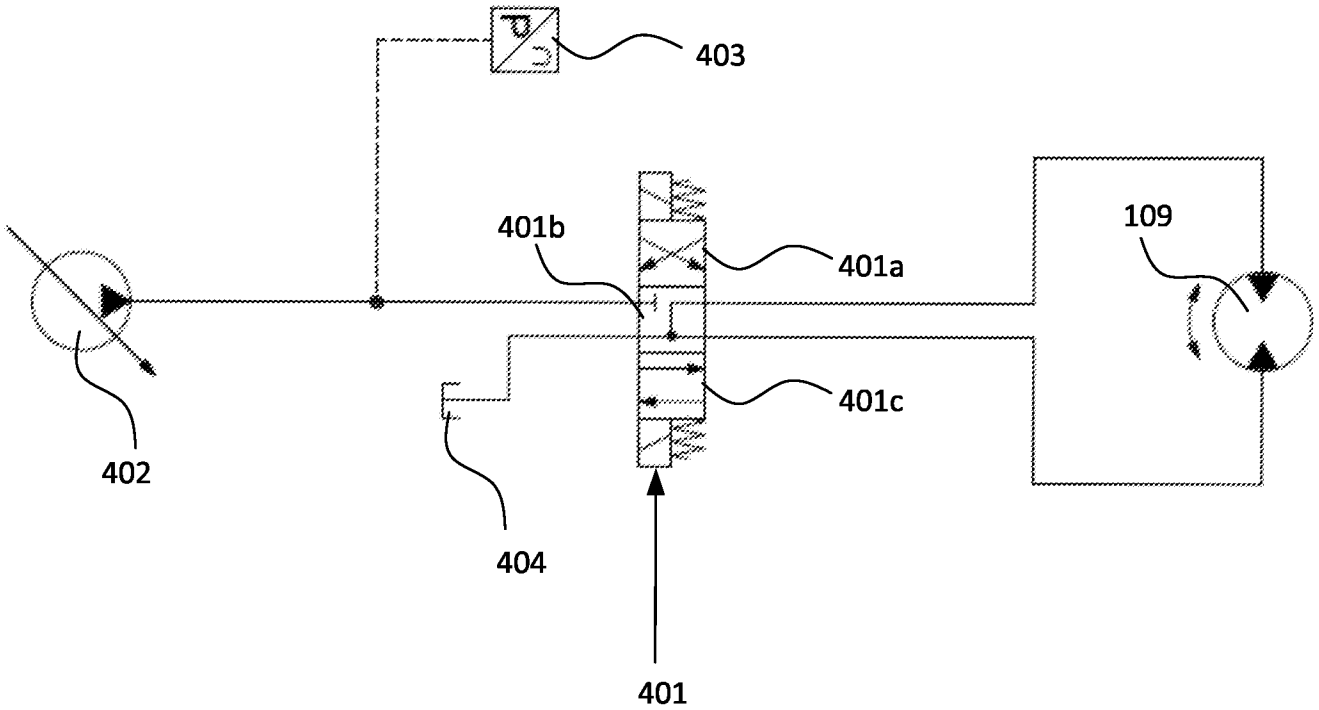
FIG. 4 illustrates an exemplary hydraulic circuit of a rotation unit being utilised according to embodiments of the invention.

When the breakout tool, i.e. joint loosening mechanism, has been prepared in step 202, the method continues to step 203, where a torque is applied by the rotation unit, which according to the present example is carried out by pressurising the rotation unit 109. The rotation unit 109 may be of various different designs and operate according to various different technologies. A non-limiting example is illustrated in FIG. 4. FIG. 4 illustrates the rotation motor 109, which may be selectively controlled to rotate in both directions of rotation in dependence of the present requirements. For example, during drilling the rotation motor is controlled to provide a rotation in a tightening direction, i.e. acts to tighten the threads of the various joints of the drill string through the rotation of the drill string. According to embodiments of the invention, on the other hand, the rotation unit 109 is utilized in the loosening of the joints, in which case rotation of the rotation unit 109 in the direction opposite to the rotation direction during drilling is utilized. The direction of rotation of the rotation motor is controlled by means of a directional control valve 401 which may be set to, according to the present example, three different states 401*a*, 401*b*, 401*c*, wherein the state 401*b* turns off the rotation whereas states 401*a*, 401*c* provides for the two different directions of rotation. According to the present example, the state 401*a* represents the setting of the rotation motor in the loosening a direction, for which reason the directional control valve 401 is set to state 401*a* in step 204.

Furthermore, according to the example of FIG. 4, the rotation motor 109 is controlled by a hydraulic pump 402 by means of which the rotation unit 109 can be controlled in regard of rotation pressure as well as speed of rotation. In step 204 of FIG. 2 the hydraulic pump 402 is set to control the rotation unit 109 according to a comparatively low speed of rotation e.g. in the order of 3 to 10 RPM, although various other different settings may be utilized. In particular, the hydraulic pump 402 is set to apply a speed of rotation of the rotation unit 109 that is below a speed of rotation as imposed by the joint loosening mechanism as will be discussed below. However, since the clamping means of the breakout tool are already set to clamp the drill string, and thereby prevent the drill string from rotation, there will be no actual rotation of the rotation unit at this stage.

Instead, a pressure of the rotation unit 109 will be built up, where the maximum pressure that may be built up may e.g. be dependent on the current configuration of the system and, for example, be in the order of 100-200 bars. The pressure of the rotation circuit is monitored through the use of a pressure sensor 403 which, according to the present example, is located upstream the directional control valve 401. This location, however, is only exemplary and may depend e.g. on the particular layout of the hydraulic circuit of the rotation unit. It is also contemplated that two or more pressure sensors may be used in this regard.

The pressure of the rotation unit will successively be built up by the hydraulic pump 402 and thereby provide a loosening torque by means of the rotation unit, although at present this torque will not act on the joint due to the clamping of the drill string by means of the clamping means of the breakout tool. The pressure build up is monitored using signals delivered by the pressure sensor 403, and it is determined in step 205 whether the pressure of the rotation unit has reached a pressure that exceeds a predetermined threshold. For as long as this is not the case the method remains in step 205 for continued pressure build up. When the pressure reaches the predetermined threshold the method continues to step 206. The pressure threshold of step 205 is preferably a threshold that corresponds to some suitable percentage of the theoretical maximum pressure to which the rotation unit may be set. The threshold, by being lower than the maximum pressure, ensures that the pressure will actually be reached. This is because the theoretical maximum pressure may not always fully correspond to the pressure that in reality may be obtained. The threshold made e.g. be a threshold in the order of 50% to 80% of the theoretical maximum pressure, although it is to be understood that other limits may alternatively be utilized.

Hence, when it is determined in step 205 that the predetermined pressure threshold has been reached, the method continues to step 206 where a break stroke is performed, i.e. a joint loosening torque is applied to the joint. This is performed while the pressurization of the rotation unit 109 is maintained. As was discussed above, the breakout tool comprises a break stroke cylinder 310. The break stroke cylinder 310 is hydraulically operated, and when performing a stroke in the direction of arrow 311 the upper portion of the breakout tool, i.e. the portion comprising clamping means 302 and clamping means 303 will rotate counter-clockwise according to the figure and according to arrow 312, in relation to the lower portion of the breakout tool, and thereby in relation to clamping means 304, 305. The break stroke cylinder 310 thereby provides a joint loosening torque on the joint. This joint loosening torque may be very high and in particular considerably higher than the joint loosening torque that the rotation unit is capable of delivering.

Furthermore, the motion carried out by the break stroke cylinder 310 will give rise to a speed of rotation of the drill string component while the stroke of cylinder 310 is ongoing. Following the commencing of the break stroke it is determined instep 207 whether the full break stroke has been completed, i.e. whether the break stroke cylinder 310 has completed the stroke length and reached an end position so that thereby the rotation imposed by the break stroke has stopped. When it is determined in step 207 that the full stroke has been performed the method continues to step 208 where the grip of the clamping means 302, 303 is released such that the break stroke cylinder 310 may be returned to its initial position for a subsequent break stroke if required and as discussed below.

In step 209 it is determined whether a rotation pressure drop was detected during the break stroke. As was discussed above, the rotation circuit is set to a predetermined speed of rotation using the hydraulic pump 402. This predetermined speed of rotation is set to a speed of rotation of the drill string that is lower than the speed of rotation that is achieved by means of the break stroke cylinder during the break stroke. This, in turn, means that when the break stroke is carried out, the flow provided by the hydraulic pump 402 will not be sufficient to maintain the pressure in the rotation circuit since the speed of rotation of the drill string, if loosened that is, will exceed the set speed of rotation of the rotation unit 109.

When this is the case the break stroke will give rise to a pressure drop in the rotation circuit during the ongoing break stroke. The pressure signals delivered by the pressure sensor 403 are therefore monitored during the break stroke and in particular it is determined whether a pressure drop exceeding a predetermined pressure drop is detected. The predetermined pressure drop may e.g. be some suitable pressure difference, e.g. a predetermined number of bars, a percentage of the pressure threshold or be determined in any other suitable way.

A detected pressure drop during the break stroke indicates that the joint was in fact loosened, and that a rotation of the drill string component (131 according to the present example) actually occurred. The pressure drop in the rotation circuit is hence used as an indicator that indicates whether the loosening of the joint was successful or not. In case it is determined in step 209 that the loosening of the joint was successful the method continues to step 210 where the joint is unthreaded so that the drill string components can be separated from each other. This unthreading may be carried out in any conventional manner, e.g. utilizing the rotation unit 109. The method then continues to step 211 where it is determined whether further joints are to be loosened, in which case the method returns to step 201. Otherwise the method is ended in step 212.

However, in the case there was no detection of a pressure drop during the break stroke this, instead, indicates that the loosening of the joint was unsuccessful. For example, the grip of the jaws of the clamping means 302, 303 may have been insufficient to sufficiently transfer the torque delivered by the break stroke piston. This may happen e.g. in case the drill string components are covered in dirt in the area of the joints and/or e.g. lubrication reduces the frictional grip of the jaws. Therefore, in case it is determined in step 209 that the loosening of the joint was not successful, the method continues to step 213 where it is determined whether there are any further break stroke attempts left. According to embodiments of the invention, only a limited number of break strokes are allowed in an attempt to loosen the joint prior to generating a signal indicating a fault. Therefore, it is determined in step 213 whether there are any attempts left, and for as long as this is the case the method returns to step 202 where the above discussed procedure is again repeated.

In case it is determined in step 213 that the maximum number of attempts have been reached, e.g. in the order of 2-7 attempts, the method continues to step 214 where the joint loosening method is stopped and an error signal is generated to alert e.g. an operator and/or the drill rig control system that the joint loosening operation was not successfully carried out.

Furthermore, in case it is determined in step 210 during the unthreading of the joint that the rotation pressure, as monitored by pressure sensor 403 during the unthreading of the joint, exceeds a pressure limit, this indicates that the joint is still not sufficiently loosened and that a further break stroke therefore should be carried out. In such cases the method continues to step 213 to determine whether further joint loosening attempts are available as discussed above.

According to embodiments of the invention, consequently, it is provided a method that is capable of determining whether a break stroke for loosening a joint was successful or not. In this way e.g. excessive break strokes with associated wear may be avoided and accurate determinations of the state of the joint may be carried out.

In addition to the above, according to embodiments of the invention, a further feature may be utilized. As discussed, the pressure of the pressure sensor 403 is monitored during the break stroke, and according to embodiments of the invention it is also determined during the break stroke whether a pressure drop is detected. When this is the case, i.e. a pressure drop is detected, it is not necessary to complete the full break stroke since the pressure drop already indicates that the joint has loosened during the part of the break stroke already performed. Therefore, according to embodiments of the invention, the break stroke is stopped as soon as a pressure drop is detected during an ongoing break stroke, since it is not necessary to continue the break stroke. This further reduces e.g. wear of jaws and drill string components.

The present invention may be utilised for essentially any kind of drill rig where a torque may be applied through clamping means gripping the drill string, and where a rotation unit may provide a torque in a joint loosening direction. The invention is applicable for underground drill rigs as well drill rigs operating above ground.

Furthermore, the invention has been exemplified with regard to a hydraulic drilling machine and hydraulic rotation unit. It is, however, also contemplated according to the invention that other technologies may be utilised, such as e.g. an electric rotation unit comprising an electrical machine. When an electric rotation unit is utilised, e.g. an electrical current can be monitored instead of a pressure according to the above, and a desired speed of rotation of the electrical machine can be set in a straightforward manner using suitable control electronics as is known per se.

The invention claimed is:

1. A method for determining loosening of a joint of a drill string of a drill rig, the joint joining a first and a second drill string component, the drill rig comprising:

a rotation unit for rotating the drill string during drilling;

means for determining a representation of a torque applied to the drill string by the rotation unit;

a joint loosening mechanism, the joint loosening mechanism is distinct from the rotation unit and is configured to: when loosening the joint, apply a first joint loosening torque acting on the drill string;

the method comprising, when loosening the joint of the drill string:

applying a torque in a joint loosening direction by means of the rotation unit;

applying the first joint loosening torque acting on the drill string by means of the joint loosening mechanism;

monitoring the representation of the torque applied by the rotation unit during the applying of the first joint loosening torque by means of the joint loosening mechanism;

determining whether the joint is loosened based on the monitored representation of the torque applied by the rotation unit; and generating a signal representing a loosened joint when the determining indicates that the joint has been loosened.

2. The method according to claim 1, further comprising:

monitoring the representation of the torque applied by the rotation unit while applying a loosening torque by the joint loosening mechanism; and determining that the joint is loosened when a predetermined variation in the monitored representation of the torque applied by the rotation unit is detected.

3. The method according to claim 1, further comprising:

determining that the joint is loosened when the monitored representation of the torque applied by the rotation unit falls below a predetermined threshold.

4. The method according to claim 1, further comprising:

setting the rotation unit to a first speed of rotation, wherein the first speed of rotation is lower than a speed of rotation imposed by the joint loosening mechanism when applying the torque to the drill string.

5. The method according to claim 1, further comprising:

applying a second joint loosening torque by means of the rotation unit such that the total loosening torque applied to the drill string exceeds the torque applied by the joint loosening mechanism.

6. The method according to claim 1, further comprising:

when the representation of the torque applied by the rotation unit indicates that the joint is still tightened following the applying of the first joint loosening torque by the joint loosening mechanism:

repeating the applying of the torque by the rotation unit and the applying of a first joint loosening torque by means of the joint loosening mechanism.

7. The method according to claim 6, further comprising:

generating an alert signal indicating a malfunction when the applying of the torque by the rotation unit and the applying of the first joint loosening torque by means of the joint loosening mechanism have been repeated for a predetermined number of times.

8. The method according to claim 1, further comprising:

stopping the applying of the first joint loosening torque by means of the joint loosening mechanism during ongoing applying of torque by the joint loosening mechanism when it is determined from the monitoring of the representation of the torque applied by the rotation unit that the joint has been loosened.

9. The method according to claim 1, further comprising:

prior to applying the torque by the rotation unit, locking the drill string against rotation at least downstream the joint as seen from the rotation unit.

10. The method according to claim 1, the joint loosening mechanism comprising a first clamping means for releasably clamping the drill string on the rotation unit side of the joint and a second clamping means for releasably holding the drill string against rotation downstream the joint in relation to the rotation unit.

11. The method according to claim 10, the joint loosening mechanism further comprising lever means for applying a torque to the drill string through a grip of the first clamping means.

12. The method according to claim 10, further comprising:

when the monitoring of the representation of the torque applied by the rotation unit indicates a loosening of the joint:

releasing a grip of the first clamping means; and unthreading the joint by means of the rotation unit to release the first and the second drill string component joined by the joint from each other.

13. The method according to claim 1, the rotation unit is hydraulically powered and the representation of the torque applied by the rotation unit is monitored by monitoring a hydraulic pressure of the rotation unit, the method further comprising, prior to applying torque by the joint loosening mechanism:

setting the rotation unit to a first speed of rotation and applying a rotation pressure acting on the rotation unit in an unthreading direction; and increasing the rotation pressure to at least a predetermined rotation pressure.

14. The method according to claim 13, further comprising:

monitoring the pressure of the rotation unit while applying a loosening torque by the joint loosening mechanism; and determining whether the joint is loosened based on a variation in the monitored rotation pressure while applying the loosening torque by the joint loosening mechanism.

15. The method according to claim 1, further comprising:

carrying out the method by means of a drill rig control system.

16. A computer program comprising instructions which, when the program is executed by a computer, cause the computer to carry out the method according to claim 1.

17. A computer-readable medium comprising instructions which, when executed by a computer, cause the computer to carry out the method according to claim 1.

18. A system for determining loosening of a joint of a drill string of a drill rig, the joint joining a first and a second drill string component, the system comprising:

a rotation unit for rotating the drill string during drilling;

means for determining a representation of a torque applied to the drill string by the rotation unit;

a joint loosening mechanism, the joint loosening mechanism is distinct from the rotation unit and is configured to, when loosening the joint, applying a joint loosening torque acting on the drill string;

means for, when loosening the joint of the drill string:

applying a torque in a joint loosening direction by means of the rotation unit;

applying a joint loosening torque acting on the drill string by means of the joint loosening mechanism;

monitoring the representation of the torque applied by the rotation unit during the applying of the joint loosening torque by means of the joint loosening mechanism;

determining whether the joint is loosened based on the monitored representation of the torque applied by the rotation unit; and generating a signal representing a loosened joint when the determining indicates that the joint has been loosened.

19. A rock drilling rig comprising a system according to claim 18.

* * * * *